US007998321B1

(12) United States Patent
Giorgini

(10) Patent No.: US 7,998,321 B1
(45) Date of Patent: Aug. 16, 2011

(54) GALVANIC ANODE FOR REINFORCED CONCRETE APPLICATIONS

(76) Inventor: Roberto Giorgini, Waddinxveen (NL)

( * ) Notice: Subject to any disclaimer, the term of this patent is extended or adjusted under 35 U.S.C. 154(b) by 204 days.

(21) Appl. No.: 12/460,883

(22) Filed: Jul. 27, 2009

(51) Int. Cl.
*C23F 13/10* (2006.01)

(52) U.S. Cl. ..... 204/196.34; 204/196.18; 204/196.19; 204/196.17; 204/196.1; 204/196.36

(58) Field of Classification Search ..... 204/196.1, 204/196.17, 196.18, 196.19, 196.23–196.25, 204/196.34, 196.36; 205/734
See application file for complete search history.

(56) References Cited

U.S. PATENT DOCUMENTS

| | | | | |
|---|---|---|---|---|
| 4,435,263 | A | 3/1984 | Lau | |
| 5,292,411 | A | 3/1994 | Bartholomew et al | |
| 6,022,469 | A | 2/2000 | Page | |
| 6,033,553 | A | 3/2000 | Bennett | |
| 6,165,346 | A | 12/2000 | Whitmore | |
| 6,562,229 | B1 | 5/2003 | Burgher et al | |
| 6,572,760 | B2 | 6/2003 | Whitmore | |
| 7,160,433 | B2 | 1/2007 | Bennett | |
| 7,488,410 | B2 | 2/2009 | Bennett et al | |
| 2007/0209949 | A1 * | 9/2007 | Whitmore | 205/730 |

* cited by examiner

*Primary Examiner* — Bruce F Bell
(74) *Attorney, Agent, or Firm* — Harpman & Harpman

(57) ABSTRACT

An improved sacrificial galvanic anode assembly for cathodic protection of a steel reinforced concrete structure. A galvanic cathodic protection device uses a multi-layered embedded sacrificial anode such as zinc covered with a flexible layer of paste to provide a continuous electrolyte to keep it active. The formulated paste is inert to cement embedment material and is pre-coated on the anode body prior to encapsulation. An integrated conductive contact band extends from within the coated anode to attachment to a reinforcement bar for establishing electrical conductively therewith in the concrete structure transferring galvanic corrosion to the anode.

10 Claims, 2 Drawing Sheets

GALVANIC ANODE FOR REINFORCED CONCRETE APPLICATIONS

BACKGROUND OF THE INVENTION

1. Technical Field

This invention relates to galvanic cathodic protection of embedded steel in concrete and the like. Specifically, to sacrificial anodes electrically linked to the steel reinforcement.

2. Description of Prior Art

Prior art devices of this type have relied on sacrificial anodes to address the issue of steel reinforcement corrosion which can and will occur due to the inherent porous nature of the concrete in which it is embedded. Such corrosion occurs when the concrete becomes contaminated with, for example, chloride ions from structural exposure to nature and user applied salt or carbonation due to carbon dioxide penetration into the concret and loosing therefore its protective alkalinity. Once this occurs, the reinforcement steel will corrode increasing its volume causing accelerated failures of the surrounding concrete structure. By the use of the electrically connected sacrificial anode connected to the reinforcement steel cathodic protection is achieved, reducing or eliminating the corrosion of the steel by making it the cathode of the electric chemical cell.

Galvanic cathodic protection using sacrificial anodes such as zinc and aluminum which have inherently negative electro chemical potentials establishes a passive protective current flow which is well known and understood in the art, see for example U.S. Pat. Nos. 4,435,263, 5,292,411, 6,022,469, 6,033,553, 6,165,346, 6,562,229, 6,572,760, 7,160,433 and 7,488,410.

In U.S. Pat. No. 4,435,263, a back fill composition for magnesium galvanic anodes is disclosed using calcium sulphite, bentonite and one compound from a group of sodium alkylates and sodium dialkyldithiocarbamates.

U.S. Pat. No. 5,292,411 is directed to a method of patching eroded concrete using a metal anode with an ionically conductive hydrogel attached to a portion of the anode being in elongated folded form.

U.S. Pat. No. 6,022,469 discloses a method by which a zinc or zinc alloyed anode is set in mortar that maintains a high PH to provide passification of the zinc anode maintaining same in an electro chemical active state.

U.S. Pat. No. 6,033,533 discloses the most effective humectants, debquescent or hydroscopic chemicals, lithium, nitrate and lithium bromine respectively to maintain a galvanic sprayed anode in active state.

U.S. Pat. No. 6,165,346 also claims a use of deliquescent chemicals to enhance the performance of the galvanic anodes.

U.S. Pat. No. 6,562,229 is drawn to a louvered metal anode with an electrocatalytically active coating on a substrate.

U.S. Pat. No. 6,572,760 illustrated the use of deliquescent material bound into a porous anode body to maintain the anodes electro chemical active properties.

U.S. Pat. No. 7,160,433 claims a cathodic protection system in which zinc anode embedded in mortar in which a humeclant is employed to impart high ionic conductivity.

Finally, U.S. Pat. No. 7,488,410 shows an anode assembly for cathodic protection using an anode covered with an ionically conductive material having an electro chemical activating agent configured to conform closely to the steel reinforcing bar in which it adjacently protects.

SUMMARY OF THE INVENTION

A galvanic cathodic protection system using a zinc anode electrically connected to an embedded reinforcing steel within a concrete structure. The anode is precoated with a unique flexible lightly acidic paste formulation to maintain continuous electivity keeping the anode active. The paste coating is an auto moistening electrolyte configuration maintaining the zinc as zinc-ions ($Zn^2$) in the acidic environment.

DETAILED DESCRIPTION OF THE INVENTION

Figure 1:
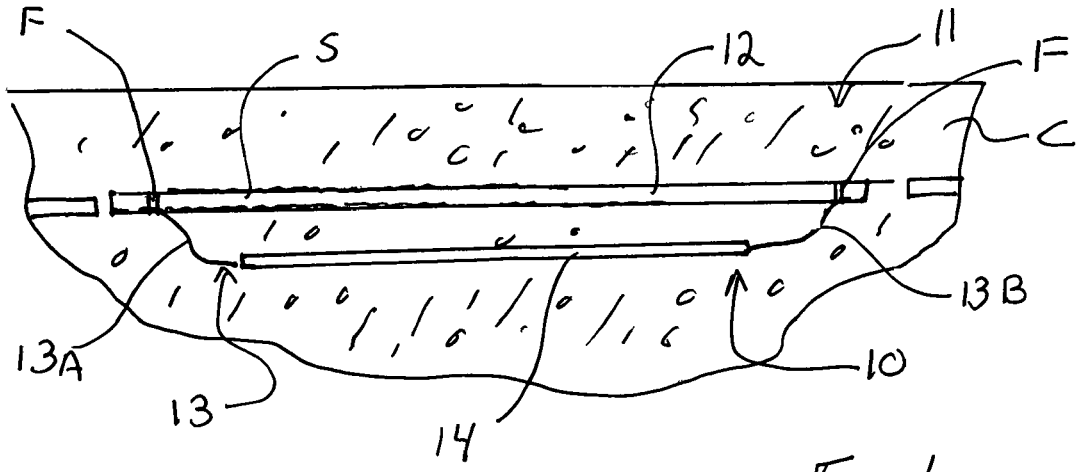
FIG. 1 is a graphic side elevational view partially in cross-section of the present invention in use.
Figure 2:
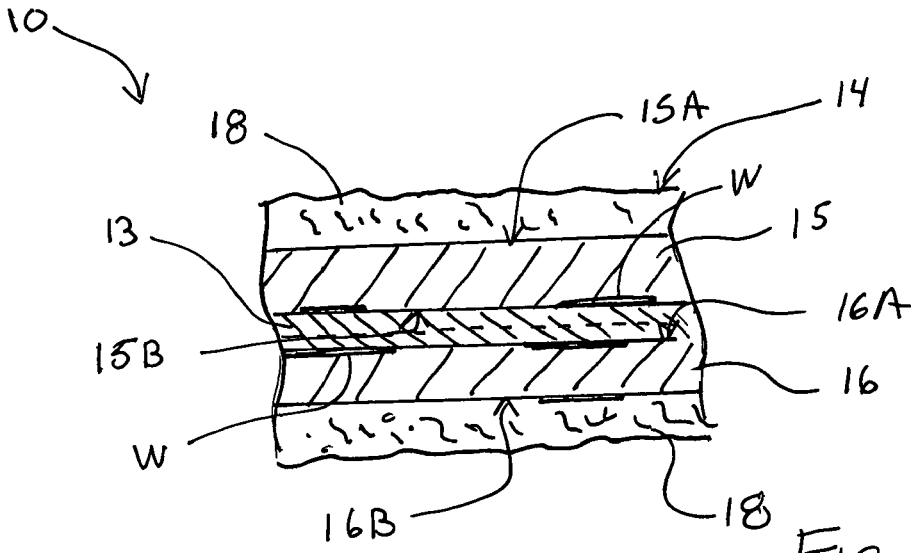
FIG. 2 is an enlarged partial sectional view of the assembled anode.
Figure 3:
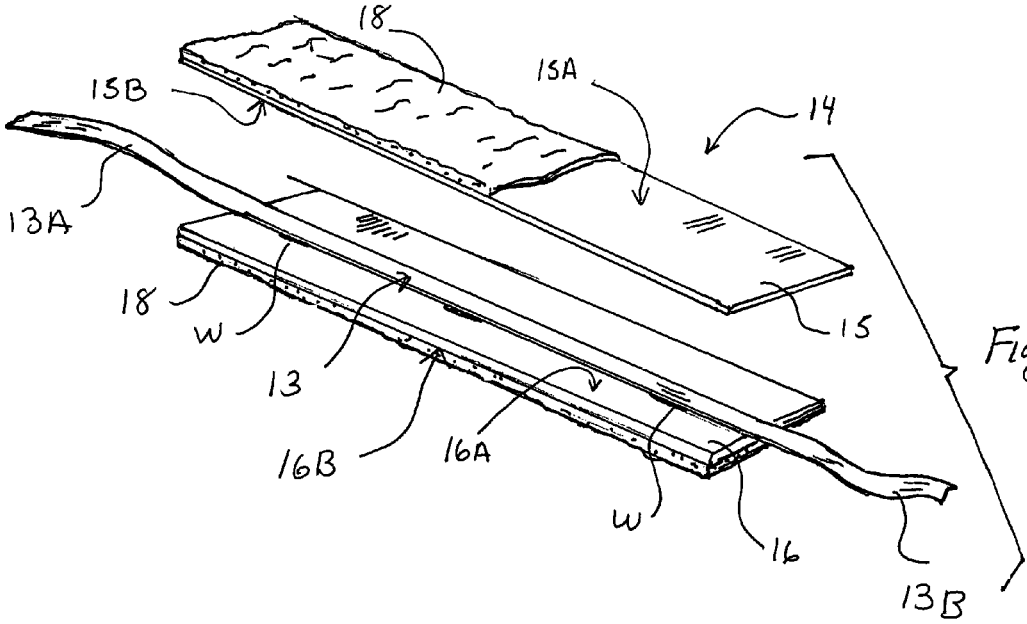
FIG. 3 is an exploded isometric view of the anode assembly of the invention.

Referring to FIG. 1 of the drawings, an anode assembly 10 of the invention can be seen, in use, embedded within a concrete structure 11 having a steel reinforcing bar 12 therewithin. The anode assembly 10 is in this example positioned adjacent the reinforcing bar 12 with an electrical interconnection band 13 extending in oppositely disposed relation outwardly therefrom. The electrical connection band 13 extending portions 13A and 13B are secured to the surface S of the reinforcement bar 12 in longitudinally spaced relation defining an electrical link with the steel reinforcement bar 12 and an electrically charged transfer flow current circuit. An anode 14 is of a multiple layer configuration, best seen in FIGS. 2 and 3 of the drawings having zinc sheets 15 and 16 each having an upper and lower contact surface 15A, 15B, 16A and 16B respectively. The zinc sheets 15 and 16 are secured together by spot welding W by their respective contact surfaces 15A and lower contact surface 16B with the electrically conductive band 13 secured first to the contact surface 15A by spot welding between the sheets 15 and 16 which are then secured together surrounding the conductive band 13 by the hereinbefore described spot welding W defining a pre-assembled anode configuration at 17.

The final assembly step of the pre-assembled anode 17 which is a key and critical aspect of the invention is an auto-moistening electrolyte paste coating 18 of the invention which is applied to the opposing exposed zinc surfaces 15B and 16A after the anode 14 is pre-assembled as hereinbefore described. The electrolyte paste coating 18 is of a flexible compound requiring no additional humectants or deliquescent to be added to keep the zinc active as is required in traditional galvanic protection process. The electrolyte paste coating 18 provides a number of important properties to assure adherence and flexibility between the anode 14 and surrounding concrete C in which it is embedded. The electrolyte paste 18 is comprised of by weight an ion conductive water based acrylic binder in the range of 10-400 parts, preferably 100 parts for a total of 25% by weight.

A hydrochloric acid in 10% solution in a range of 5-60 parts preferably 60 parts or 15% by weight.

An inert filler material, in this example, mica in the range of 50-400 parts or 50% by weight.

An alcohol based water binder, in this example, polyol in the range of 0-100 parts preferably 40 parts or 10% by weight.

It will be evident that components of the electrolyte paste 18 such as the acrylic binder and inert filler mica can be one selected from a corresponding family of like materials having similar properties and can be easily substituted within the perview of one skilled within the art and such composition as defined by this example are therefore not limited thereto.

Given this composition, the electrolyte paste coating 18 is thus lightly acidic with a PH in the range of 4.5 to 6 therefore not neutralized by the alkaline cement and provides higher current densities and is more durable than the prior art alkaline coatings having a typical PH of 12 or above which was previously thought to, be required and helped to maintain the zinc in an active state.

Such acidic environment maintained by the paste 18, the coated zinc anode remains active and remains as a zinc-ion $Zn^2$. Thus when even small amounts of chlorides are present, a preferential reaction will occur between the zinc and the chloride into $ZnCl^2$. Zinc chlorides are found to be highly soluble and hygroscopic and therefore will not form any insoluble passive layer on the zinc thus effectively auto moistening, assuring that no additional humectants or deliquescent as needed to keep the zinc active. The electrolyte paste 18 formulation used with the anode assembly 17 of the invention will be of superior performance binding sufficient water for proper conductivity with no chemical interaction between the paste 18 and concrete alkaline pore water solution.

Figure 4:
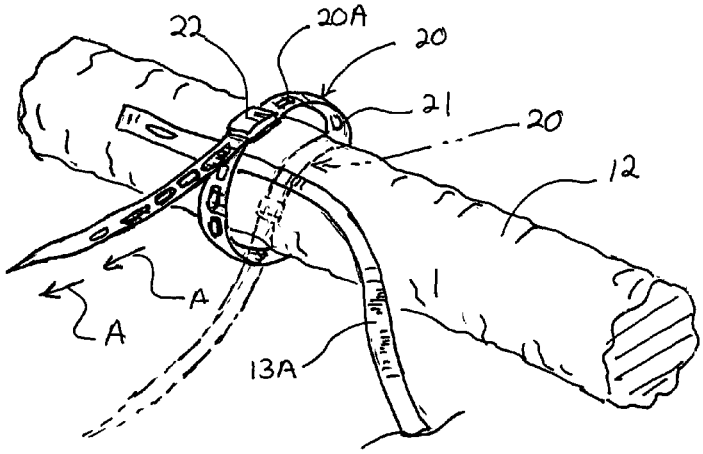
FIG. 4 is an enlarged perspective partial view of an electrically conductive tie for securing the anode conductors to the reinforcing bar.

Referring now to FIGS. 1 and 4 of the drawings, an anode attachment tie 20 can be seen for securing the anode electrical interconnection bands 13 to the reinforcing bar 12 before embedding into the concrete C of the so defined structure 11 as hereinbefore described. The anode attachment tie 20 preferably formed from a flexible steel band body 21 having an adjustable lock to length pass through one-way ratchet fastener fitting 22 on one end thereof. The band body 21 defines a ladder tie configuration with engageable surface openings at 20A therein which allows for adjustable registration within the fastener fitting 22, locking the effective tie band engagement length about the reinforcement bar 12 mechanically and electrically joining the interconnecting bands 13A and 13B thereto illustrated by adjustment arrows A in broken lines in FIG. 4 of the drawings and fasteners F in solid lines in FIG. 1 of the drawings.

It will thus be seen that a new and novel galvanic cathodic protection system utilizing a zinc anode assembly coated with a unique auto moistening electrolyte paste having an effective low PH range has been illustrated and described and it will be apparent to those skilled in the art that various changes and modifications may be made therein without departing from the spirit of the invention.

Therefore I claim:

1. A galvanic cathodic protection system for reinforced concrete structures comprising, a sacrificial anode assembly embedded within said concrete structure in close proximity to a reinforcing bar therewithin, said anode assembly having multiple layered anode members secured to one another, an elongated electrically conductive member extending from said anode layers in electrical communication with said reinforcing bar for protective current flow, an electrolyte paste coating said exposed surface of said anode layers, said electrolyte paste having acidic properties of a pH of 4.5-6 and non-reactive to alkaline cement, and means for adjustable conductive attachment of said anode electrically conductive member with said reinforcement bar.

2. The galvanic cathodic protection system set forth in claim 1 wherein said anode member is zinc or a zinc alloy.

3. The galvanic cathodic protection system set forth in claim 1 wherein said multiple layered anode members and said electrically conductive member are secured together by welding.

4. The galvanic cathodic protection system set forth in claim 1 wherein said acidic electrolyte paste coating containing 25% by weight ion conductive water based acrylic, 15% by weight hydrochloric acid in a 10% solution, 50% by weight of inner filler material mica and 10% by weight alcohol based water binder polyol.

5. The galvanic cathodic protection system set forth in claim 1 wherein said electrolyte paste coating on said assembled zinc anode is flexible and auto moistening.

6. The galvanic cathodic protection system set forth in claim 1 wherein said means for adjustably conductively attachment of said electrically conductive member with said reinforcing bar comprises, a ferrous metal flexible tie.

7. The ferrous metal tie set forth in claim 6 wherein said ferrous metal tie comprises a steel strap and, a one-way locking fastener fitting on one end thereof for slidably receiving a free end of said strap therethrough.

8. A galvanic cathodic protection device for steel reinforced concrete is structures comprises, a sacrificial anode assembly in electrical communication with a reinforcing bar embedded within said concrete structure, an electrolyte flexible paste coating on said anode, said electrolyte paste coating having an acid property of a pH range of 4.5" to 6.

9. A galvanic cathodic protection device set forth in claim 8 wherein said anode is zinc.

10. The galvanic cathodic protection device set forth in claim 8 wherein said electrical communication with said reinforcing bar comprises, an electrical conducted band extending from said anode in oppositely disposed directions to said reinforcing bar.

* * * * *